US005631442A

United States Patent [19]

Becker et al.

[11] Patent Number: 5,631,442

[45] Date of Patent: May 20, 1997

[54] MISSILE HAVING A PIVOTAL WARHEAD

[75] Inventors: Wilfried Becker, Düsseldorf; Dirk Kilfitt, Velbert; Werner Grosswendt, Ratingen, all of Germany

[73] Assignee: Rheinmetall Industrie GmbH, Ratingen, Germany

[21] Appl. No.: 641,642

[22] Filed: May 1, 1996

[30] Foreign Application Priority Data

May 4, 1995 [DE] Germany ..... 195 16 341.9

[51] Int. Cl.[6] ..... F42B 12/20

[52] U.S. Cl. ..... 102/475; 102/473; 102/494

[58] Field of Search ..... 102/473, 475, 102/476, 489, 491–497, 305; 244/3.21, 3.22, 3.16

[56] References Cited

U.S. PATENT DOCUMENTS

| | | | |
|---|---|---|---|
| H345 | 10/1987 | Williamsen et al. | 102/476 |
| H362 | 11/1987 | Madderra | 102/476 |
| 2,952,207 | 9/1960 | Kamimoto | 244/3.21 |
| 4,415,130 | 11/1983 | Staehlin | 244/3.15 |
| 4,579,298 | 4/1986 | Thomson | 244/3.21 |
| 4,640,194 | 2/1987 | Witt et al. | 102/476 |
| 4,693,182 | 9/1987 | Winblad | 102/476 |

FOREIGN PATENT DOCUMENTS

| | | | |
|---|---|---|---|
| 3605579 | 5/1987 | Germany | 102/476 |
| 3820183 | 2/1990 | Germany | 102/476 |
| 2149066 | 6/1985 | United Kingdom | 102/476 |
| 2161907 | 1/1986 | United Kingdom . | |

*Primary Examiner*—Harold J. Tudor
*Attorney, Agent, or Firm*—Spencer & Frank

[57] ABSTRACT

A missile includes a warhead accommodated in an inner space at a front portion of the missile; a ball joint being in alignment with the longitudinal missile axis and pivotally supporting the warhead; and an aiming device for placing the warhead into a desired pivotal orientation. The aiming device includes a plurality of inflatable vessels arranged axially adjacent the warhead in a distribution about the missile axis. Each vessel has a first end oriented toward the warhead and a second end oriented away therefrom. The vessels are supported at their second end by a disk situated in the inner space of the missile. A gas generator is coupled to each vessel for charging the vessel with a gas to place the vessel into its inflated state. In the inflated state each vessel exerts a torque on the warhead about the ball joint by an engagement between the first end of the respective vessel and the warhead. Further, an electronic control system is accommodated in the inner space of the vessel. The electronic control system is connected to each gas generator for actuating a selected gas generator to place the warhead into a desired inclined orientation relative to the missile axis.

7 Claims, 2 Drawing Sheets

MISSILE HAVING A PIVOTAL WARHEAD

BACKGROUND OF THE INVENTION

This invention relates to a missile which carries in its interior a warhead that is pivotally supported by means of a ball joint. The pivotal motion of the warhead is effected by an aiming device controlled by an electronic control system.

Missiles which attack a target in the course of their flight over or past the target without the need of proceeding directly thereagainst are known and are described, for example, in German Patent No. 3,605,579. The missile has an internal warhead which, in flight, may be pivoted in a direction towards the target by virtue of its ball joint support. After target detection, for example, by onboard sensors, the warhead is oriented into the optimal direction and fired by means of an aiming device and an electronic control system. As a result of this process, one or more payload units are ejected or accelerated in the direction of the target. The above-noted patent, however, does not describe an appropriate aiming device which may effect a pivotal motion of the warhead.

SUMMARY OF THE INVENTION

It is an object of the invention to provide an improved missile of the above-outlined type which has an aiming device of simple construction which may rapidly and accurately pivot the warhead into the desired orientation towards the target.

This object and others to become apparent as the specification progresses, are accomplished by the invention, according to which, briefly stated, the missile includes a warhead accommodated in an inner space at a front portion of the missile; a ball joint being in alignment with the longitudinal missile axis and pivotally supporting the warhead; and an aiming device for placing the warhead into a desired pivotal orientation. The aiming device includes a plurality of inflatable vessels arranged axially adjacent the warhead in a distribution about the missile axis. Each vessel has a first end oriented toward the warhead and a second end oriented away therefrom. The vessels are supported at their second end by a disk situated in the inner space of the missile. A gas generator is coupled to each vessel for charging the vessel with a gas to place the vessel into its inflated state. In the inflated state each vessel exerts a torque on the warhead about the ball joint by an engagement between the first end of the respective vessel and the warhead. Further, an electronic control system is accommodated in the inner space of the vessel. The electronic control system is connected to each gas generator for actuating a selected gas generator to place the warhead into a desired inclined orientation relative to the missile axis.

In essence, according to the invention a plurality of inflatable, airbag-like vessels are disposed underneath the warhead about the missile axis which passes through the ball joint. Each of the inflatable vessels is coupled with a gas generating device which may be ignited separately by the electronic control system so that the warhead may be tilted in a determined sector. The gas generated upon igniting flows into the inflatable vessel which may be, for example, a pre-folded sheet metal body. The configuration of the inflated vessel fixes the position of the warhead. Thereafter the payload is ejected from the warhead in its oriented position.

To make possible the arrangement of identical inflatable vessels about the longitudinal missile axis and to thus be able to construct the aiming device in a modular manner, the inflatable vessels are countersupported by a planar, disk-like body at their side oriented away from the warhead. A corresponding disk-like body (bottom plate) is preferably also disposed at the bottom of the warhead.

To be able to aim the warhead towards the target in a manner which is as accurate as possible, according to a further feature of the invention the ball of the ball joint is mounted on an axially shiftable carrier.

Particularly pyrotechnical gas generators have been found to be advantageous as gas generators since they are capable of very rapidly expanding the inflatable body.

DESCRIPTION OF THE PREFERRED EMBODIMENT

Figure 1:
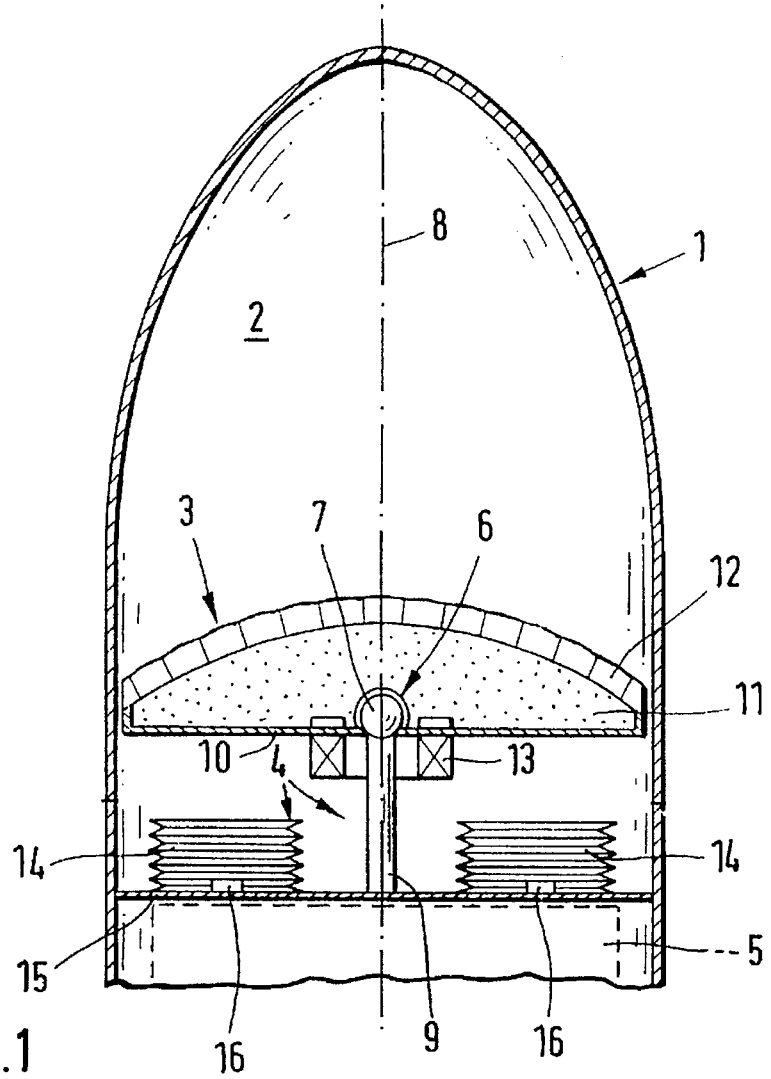
FIG. 1 is a schematic axial sectional view of a preferred embodiment of the invention, showing a front part of a missile body including a warhead in a normal position.

FIG. 1 shows a missile 1 which in an inner space 2 of its front portion accommodates a warhead 3, an aiming device 4 and an electronic control device 5.

The warhead 3 is pivotally supported on a ball joint 6 whose ball 7 is mounted on a carrier 9 which is aligned with the missile axis 8 and which may telescope parallel thereto. The warhead 3 has a disk-shaped bottom member (bottom plate) 10 which supports a charge 11 covered by an arcuate fragmentation plate 12. The charge 11 may be ignited by an annular ignition charge 13.

Figure 3:
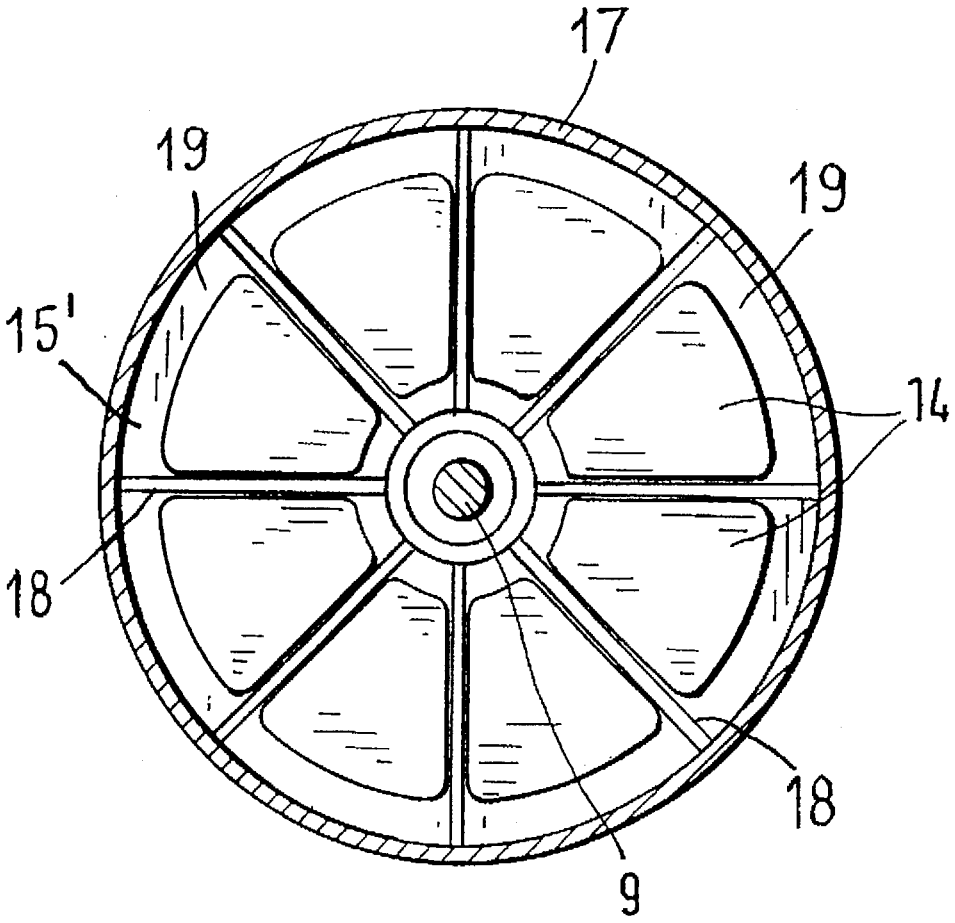
FIG. 3 is a sectional top plan view of a compartmentalized container accommodating components according to the invention.

Also referring to FIG. 3, the aiming device 4 is formed of eight folded, inflatable sheet metal vessels 14 which are positioned in a circular array around the longitudinal axis 8 of the missile 1. At their end remote from the warhead 3 the inflatable vessels 14 are counter supported on a disk 15 positioned in the inner space 2 of the missile 1.

While in the FIG. 1 construction the vessels 14 are positioned directly in the inner space 2, according to FIG. 3 a separate container 17 is provided which accommodates the vessels 14 and which, with the vessels 14, constitutes a modular unit. The container 17 has a plurality of radial partitions 18 defining compartments 19, each receiving a separate vessel 14. The container 17 may have a circular base 15' which performs the vessel-supporting function of the disk 15 shown in the structure of FIGS. 1 and 2. Furthermore, the base body 10 of the warhead 4 may constitute the top plate of the container 17 in which case the warhead 3 and the aiming device 4 form a single structural unit which may be pre-assembled.

With each vessel 14 a pyrotechnical gas generator 16 is associated which may be activated separately by the electronic control system 5.

In the description which follows, the operation of the above-described apparatus will be set forth.

Figure 2:
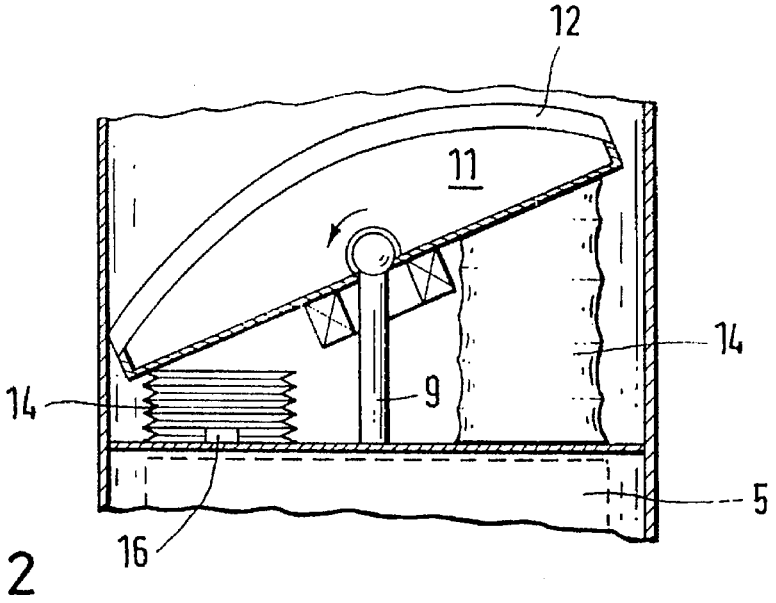
FIG. 2 is a detail of FIG. 1 showing the warhead pivoted towards a target.

With the aid of a non-illustrated seeking head of the missile 1 or a ground station the trajectory of an incoming target (for example, an airplane) or the trajectory of the missile 1 itself is determined by extrapolation of the zone of encounter between the missile 1 and the target. As soon as a determination is made that a direct hit is not feasible, the warhead 3 is pivoted into a proper orientation with the aid of the aiming device 4. For this purpose the electronic control system 5 activates the corresponding pyrotechnical gas generators 16 as shown in FIG. 2. The gas generated as a result of the ignition flows into the respective inflatable vessel 14 which, as a result, pushes the warhead from below and thus pivots it into the opposite direction and fixes it in its tilted end position. Upon reaching the optimal moment of ignition, the charge 11 is ignited and the fragment cluster generated by exploding the fragmentation plate 12 flies in the direction of the target after destroying the side wall of the missile 1.

It is to be understood that the invention is not limited to the above-described embodiment. Thus, for example, instead of a charge with a fragmentation plate, the warhead may be a shaped charge or a projectile-forming charge. Instead of sheet metal, the inflatable body may be made of plastic.

It will be understood that the above description of the present invention is susceptible to various modifications, changes and adaptations, and the same are intended to be comprehended within the meaning and range of equivalents of the appended claims.

What is claimed is:

1. A missile having a longitudinal axis and a frontal portion defining an inner space, comprising (a) a warhead accommodated in said inner space;

(b) a ball joint being in alignment with said longitudinal axis and pivotally supporting said warhead;

(c) an aiming device for placing said warhead into a desired pivotal orientation; said aiming device including (1) a plurality of inflatable vessels arranged axially adjacent said warhead in a distribution about said longitudinal axis; each said vessel having a first end oriented toward said warhead and a second end oriented away therefrom; each said vessel having a deflated state and an inflated state;

(2) a disk supporting said vessels by engagement with said second ends thereof;

(3) a separate gas generator coupled to each said vessel for charging the vessel with a gas to place the vessel into said inflated state; in the inflated state each vessel exerting a torque on said warhead about said ball joint by an engagement between said first end of said vessel and said warhead; and (d) an electronic control system accommodated in said inner space; said electronic control system being connected to each said gas generator for actuating a selected said gas generator to place said warhead into a desired inclined orientation relative to said longitudinal axis.

2. The missile as defined in claim 1, further comprising a container divided into compartments; each said vessel being accommodated in a separate said compartment.

3. The missile as defined in claim 1, wherein said vessels comprise a prefolded sheet metal body.

4. The missile as defined in claim 1, wherein said gas generator is a pyrotechnical gas generator.

5. The missile as defined in claim 1, further comprising a carrier displaceably supported in said inner space for shifting motions parallel to said longitudinal axis; said ball joint being mounted on said carrier.

6. The missile as defined in claim 1, wherein said warhead and said aiming device constitute a single structural unit.

7. The missile as defined in claim 6, said warhead having a base body; further comprising a container divided into compartments; each said vessel being accommodated in a separate said compartment; said container having a base constituting said disk and a cover plate constituting said base body of said warhead.

* * * * *